United States Patent [19]

Fennemann et al.

[11] 4,330,342

[45] May 18, 1982

[54] PROCESS FOR REGENERATING SPENT PICKLE LIQUID CONTAINING $ZRF_4$

[75] Inventors: Wolfgang Fennemann, Karben; Jürgen Haldorn, Oberursel, both of Fed. Rep. of Germany

[73] Assignee: Metallgesellschaft Aktiengesellschaft, Frankfurt am Main, Fed. Rep. of Germany

[21] Appl. No.: 238,329

[22] Filed: Feb. 26, 1981

[30] Foreign Application Priority Data

Mar. 11, 1980 [DE] Fed. Rep. of Germany ..... 3009265

[51] Int. Cl.[3] ..... C23G 1/36

[52] U.S. Cl. ..... 134/13; 210/712; 210/737; 423/72

[58] Field of Search ..... 134/13; 423/72, 84, 423/85, 464; 23/300, 302 T; 210/702, 712, 724, 737

[56] References Cited

U.S. PATENT DOCUMENTS

| | | | |
|---|---|---|---|
| 2,743,160 | 4/1956 | Wainer | 423/72 |
| 2,812,237 | 11/1957 | Wainer | 423/72 |
| 3,048,503 | 8/1962 | Foote et al. | 134/13 X |
| 4,105,469 | 8/1978 | Megy et al. | 134/13 X |

FOREIGN PATENT DOCUMENTS

| | | | |
|---|---|---|---|
| 2828547 | 1/1980 | Fed. Rep. of Germany | 134/13 |

*Primary Examiner*—Marc L. Caroff

*Attorney, Agent, or Firm*—Sprung, Horn, Kramer & Woods

[57] ABSTRACT

A process for regenerating a spent $HF\text{-}HNO_3$ pickle which contains $ZrF_4$, which comprises heating said spent pickle to above 40° C., adding dissolved NaOH to said so-heated pickle, thereafter cooling said so-treated pickle to a temperature below 20° C. whereby to precipitate $Na_2ZrF_6$ and removing said $Na_2ZrF_6$ from said so-cooled pickle whereby to regenerate the same.

11 Claims, 1 Drawing Figure

$H_2O$
HF
$Na_2ZrF_6$
NaOH
$HNO_3$
1
2
3
4
5
6
7
8
9
10
11
12
13
14
15
16
17
18
19
20
21

PROCESS FOR REGENERATING SPENT PICKLE LIQUID CONTAINING $ZRF_4$

BACKGROUND OF THE INVENTION

1. Field of Invention

This invention relates to a process of regenerating an $HF-HNO_3$ pickle which contains $ZrF_4$, wherein $ZrF_4$ is precipitated as $Na_2ZrF_6$, the precipitated $Na_2ZrF_6$ is removed, and HF, $HNO_3$ and, if required, $H_2O$ are made up.

2. Discussion of Prior Art

Such process has been disclosed in U.S. Pat. No. 4,105,469. In the known process, $ZrF_4$ is precipitated as $Na_2ZrF_6$ from the spent pickle by an addition of crystalline NaF and is removed by filtration. That process avoids the disadvantages of the earlier processes in which the spent pickles were neutralized and disposed of so that their zirconium content was lost. However the known process is still relatively expensive and can be carried out only with difficulty.

Because NaF has only a low solubility in water, the precipitant must be added in crystalline form so that an exact proportioning is difficult, particularly in a continuous regenerating process. An addition of dissolved precipitant would excessively dilute the pickle so that the surplus water would have to be removed after the regeneration proper. Besides, NaF is a rather expensive precipitant.

Morever, the process will be adversely affected by an addition of the precipitant in a proportion which is too high or too low. If the regenerated pickle recycled to the pickling bath contains an excessively high content of residual NaF because the precipitant had been added in an excessively high proportion, a precipitation of $Na_2ZrF_6$ will already be initiated in the pickling bath so that the pickling operation will be adversely affected. For reasons of safety, zirconium can be precipitated in the known processes only to a residual content of 3 to 7 grams per liter in the regenerated pickle.

On the other hand, the addition of the precipitant in a proportion which is too low results in the formation of $NaZrF_5.H_2O$, which is gellike and can be filtered only with difficulty.

It is an object of the invention to provide a process which is of the kind described first hereinbefore and is less expensive and can be carried out more easily and in which the disadvantages which have been described are avoided.

SUMMARY OF INVENTION

This object is accomplished in accordance with the invention in that the spent pickle is first heated above 40° C., dissolved NaOH is then added to the pickle, which is subsequently cooled below 20° C., whereafter precipitated $Na_2ZrF_6$ is removed by filtration. According to a preferred further feature of the invention, $HNO_3$ is made up before the precipitation and HF and if required, $H_2O$, are made up after the removal of the precipitate. NaOH is preferably added to the pickle when the latter is at a temperature of 50° to 60° C. The spent pickle can be heated, if desired, up to 80° or 100° C. without any disadvantage to the process. Such heating however would be less economical and has no further improvements. The precipitate is suitably removed from the pickle when the latter is at a temperature of −20° to +10° C. NaOH is preferably added in such an amount that the regenerated pickle contains 1 to 3 grams sodium per liter and 1.5 to 2.5 grams zirconium per liter. The regenerated pickle is preferably adjested to contain 1.5 to 2.5 grams sodium per liter.

The process can be carried out in that spent pickle is continuously withdrawn from a pickling plant and regenerated pickle is continuously supplied to the pickling plant. The contents of HF, $HNO_3$ and sodium in the pickle can be continuously measured and the addition of NaOH, $HNO_3$ and HF and, if required, water may be automatically controlled in dependence on the measured contents. Finally, the pickle may be heated and cooled by means of a circulating heat transfer fluid which has a suitable boiling point.

In the process according to the invention, the following reactions take place in the spent pickle:

$$NaOH + HF \rightarrow NaF + H_2O \quad (1)$$

$$ZrF_4 + 2NaF \rightarrow Na_2ZrF_6 \quad (2)$$

Because the solubility of NaOH is about 12 times the solubility of NaF, the addition of NaOH in dissolved form will not appreciably disturb the water balance. In the process according to the invention, a certain quantity of HF is consumed for the formation of NaF but the costs of the NaOH and HF required to regenerate a given quantity of pickle are only about 50% of the costs of the NaF which must be added in the known process. Additionally the proportioning is facilitated by the addition of NaOH in solution.

Generally speaking, the sodium hydroxide is added in the form of an aqueous solution. The concentration of this solution is preferably 40 to 50%. Lower concentrations may be used if $H_2O$ has to be supplied, but it is much more advantageous to add the necessary amount of $H_2O$ not together with the sodium hydroxide (of lower concentration) but after removal of $Na_2ZrF_6$, because otherwise the solubility of $Na_2ZrF_6$ would be increased and the precipitation unfavorably influenced.

The consumption of HF affords an additional advantage. As the solubility of $Na_2ZrF_6$ decreases with a decreasing HF content, the precipitation will be more strongly promoted than is possible by the cooling alone. The solubility of $Na_2ZrF_6$ is also influenced by the $HNO_3$ content and decreases as the $HNO_3$ concentration increases. For these reasons, the strengthening with $HNO_3$ must be carried out before the precipitate is added and the strengthening with HF must be carried out after the filtration.

In accordance with the invention tthe spent pickle is heated in order to avoid a formation of $NaZrF_5.H_2O$. It has been found that said compound, which can be filtered only with difficulty because it is gellike, will not form when the precipitation is initiated at an elevated temperature, regardless of the presence of NaOH in an adequate proportion.

In accordance with the invention the pickle is cooled after the precipitant has been added. This cooling reduces the solubility of $Na_2ZrF_6$, Zr is precipitated to a high degree, and a crystalline $Na_2ZrF_6$ salt is produced, which can readily be dewatered. Unless the temperatures according to the invention are employed, the filter cake obtained by a standardized filtering method still contains 50 to 60% adherent moisture and the filtering rates amount to 10 to 140 kilograms of salts per hour and square meter of filter surface and are not reproducible. The corresponding values obtained in the process according to the invention were as follows:

About 20% moisture;

350 to 400 kg salt per hour and square meter of filter surface.

Owing to the combination of all measures according to the invention, the process is much less expensive in spite of the consumption of additional HF and can be carried out much more easily than the known process. Zirconium can be precipitated to a residual content of 1 to 2.5 grams per liter in the regenerated pickle. The process is highly suitable for continuous operation. The precipitated $Na_2ZrF_6$ can easily be recovered out of the suspension in the form of a well dewatered salt, which can be dried in known manner at relatively low cost and can be used for other purposes. Because the content of HF, $HNO_3$ and Na in the pickle can be continuously measured without special difficulties, the process can be carried out in a fully automatic plant if suitable measuring and control means are used.

The required heating and cooling of the pickle can be effected with a minimum of energy if the heat extracted from the pickle stream to cool the latter is used for heating. A heat transfer medium which is circulated through a heat pump can be used to effect the required temperature increase.

BRIEF DESCRIPTION OF DRAWING

Further details will be explained with reference to FIG. 1 which is a flow diagram showing an illustrative embodiment of a plant for the continuous regeneration of the pickle.

DESCRIPTION OF SPECIFIC EMBODIMENT

Figure 1:
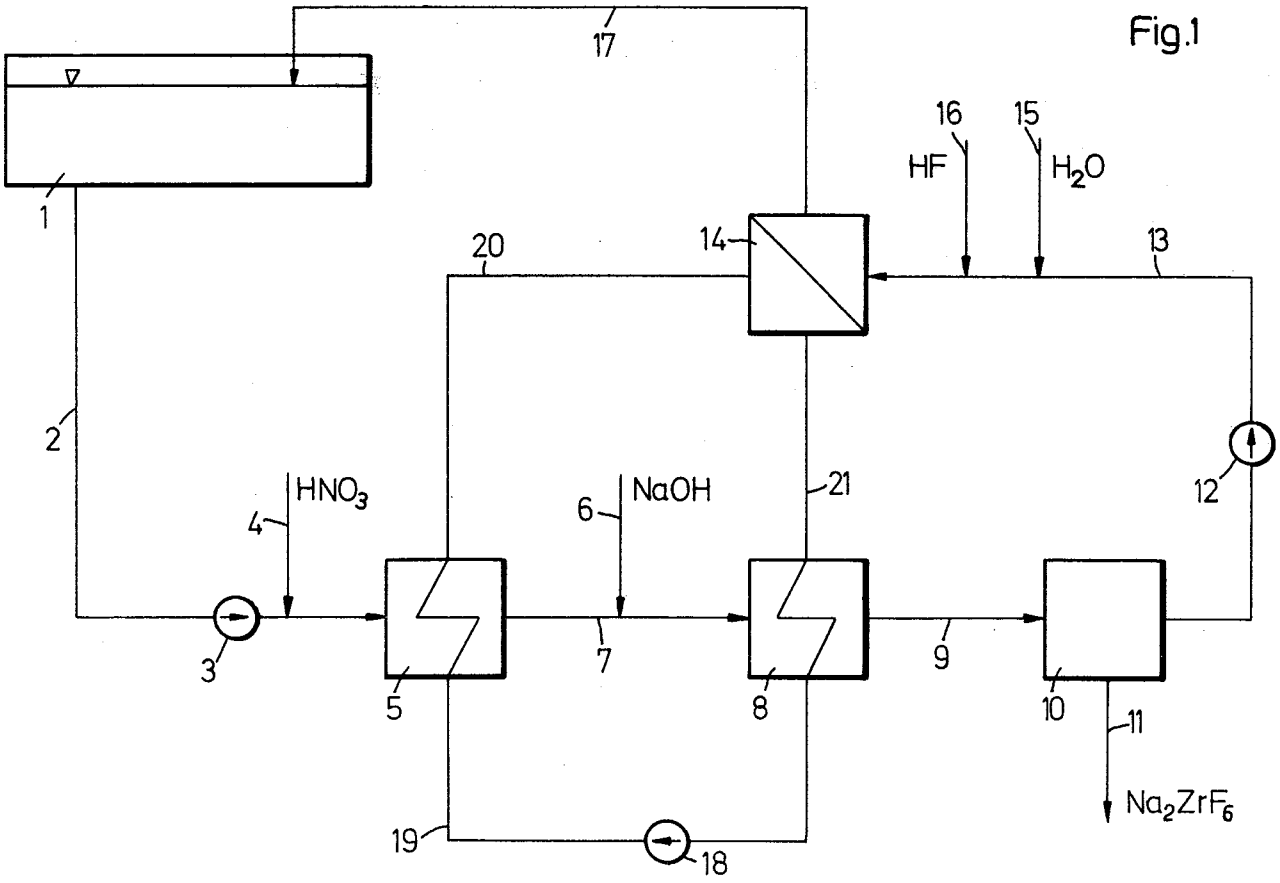

Spent pickle from a pickling bath 1 is fed by pump 3 through conduit 2 to the heat exchanger 5 after $HNO_3$ has been made up before at 4. When the pickle has been heated above 40° C. in the heat exchanger 5, NaOH as precipitant is added at 6 to initiate the precipitation. The pickle is then fed through conduit 7 to the heat exchanger 8 and is colled therein below 20° C. to complete the precipitation. The pickle is subsequently fed through conduit 9 to the filter 10, from which the precipitated $Na_2ZrF_6$ is withdrawn at 11. When $H_2O$ has been made up at 15 and HF at 16, the pickle is fed by the pump 12 through conduit 13 to the heat exchanger 14, where it is heated to the temperature of the pickling bath, to which it is supplied through conduit 17. The cycle for the heat transfer fluid consists essentially of the compressor 18 and the conduits 19, 20 and 21. Heat transfer fluid vapor is sucked from the heat exchanger and is compressed in the compressor 18 and then liquefied as it is cooled in heat exchangers 5 and 14. The heat transfer medium is fed through a constricted passage to the heat exchanger 8, where it is evaporated with absorption of heat.

What is claimed is:

1. A process for regenerating a spent HF-$HNO_3$ pickle liquid which contains $ZrF_4$, which comprises heating said spent pickle liquid to above 40° C., adding an aqueous solution containing dissolved NaOH to said so-heated pickle liquid in an amount sufficient to form $Na_2ZrF_6$, thereafter cooling said so-treated pickle liquid to a temperature below 20° C. whereby to precipitate said $Na_2ZrF_6$ and removing said $Na_2ZrF_6$ from said so-cooled pickle liquid whereby to regenerate the same.

2. A process according to claim 1, wherein make up $HNO_3$ is added to said spent pickle liquid before precipitation of said $Na_2ZrF_6$.

3. A process according to claim 2, wherein make up HF and $H_2O$ are added to said spent pickle liquid after removal of precipitated $Na_2ZrF_6$.

4. A process according to claim 2, wherein said make up $HNO_3$ is added to said spend pickle liquid before the same is heated to a temperature above 40° C.

5. A process according to claim 1, wherein said NaOH is added to said so-heated pickle liquid while the latter is at a temperature of 50° to 60° C.

6. A process according to claim 1, wherein said NaOH treated pickle liquid is cooled to a temperature between −20° and +10° C., whereby to precipitate $Na_2ZrF_6$.

7. A process according to claim 1, wherein NaOH is added in such an amount that the regenerated pickle liquid contains 1 to 3 grams sodium per liter and 1.5 tto 2.5 grams zirconium per liter.

8. A process according to claim 7, wherein the regenerated pickle liquid contains 1.5 to 2.5 grams sodium per liter.

9. A process according to claim 1, wherein said spent pickle liquid is continuously withdrawn from a pickling plant, continuously regenerated and continuously supplied to said pickling plant after being regenerated.

10. A process according to claim 9, wherein the content of HF, $HNO_3$ and sodium in said pickle liquid are continuously measured and addition of NaOH, $HNO_3$ and HF and, if required, $H_2O$ to the pickle liquid is automatically controlled in dependence on the measured contents.

11. A process according to claim 1, wherein said pickle liquid is heated to a temperature above 40° C. and cooled to a temperature below 20° C. by means of a circulating heat transfer fluid.

* * * * *